US007531051B2

(12) United States Patent
Nakayama et al.

(10) Patent No.: US 7,531,051 B2
(45) Date of Patent: May 12, 2009

(54) TREATING SOLUTION FOR METAL SURFACE TREATMENT AND A METHOD FOR SURFACE TREATMENT

(75) Inventors: Takaomi Nakayama, Tokyo (JP); Hiroyuki Sato, Tokyo (JP); Tetsuo Ootsuki, Totyo (JP); Tadashi Matsushita, Totyo (JP); Eisaku Okada, Toyota (JP); Fumiya Yoshida, Ikeda (JP); Katsuhiro Shiota, Ikeda (JP)

(73) Assignees: Nihon Parkerizing Co., Ltd., Tokyo (JP); Toyota Jidosha Kabushiki Kaisha, Aichi (JP); Daihatsu Motor Co., Ltd., Osaka (JP)

( * ) Notice: Subject to any disclaimer, the term of this patent is extended or adjusted under 35 U.S.C. 154(b) by 476 days.

(21) Appl. No.: 10/480,841

(22) PCT Filed: Jun. 12, 2002

(86) PCT No.: PCT/JP02/05860

§ 371 (c)(1),
(2), (4) Date: Jul. 19, 2004

(87) PCT Pub. No.: WO02/103080

PCT Pub. Date: Dec. 27, 2002

(65) Prior Publication Data

US 2004/0244874 A1 Dec. 9, 2004

(30) Foreign Application Priority Data

Jun. 15, 2001 (JP) ..... 2001-182365
Jun. 15, 2001 (JP) ..... 2001-182366
Sep. 6, 2001 (JP) ..... 2001-269995

(51) Int. Cl.
*C23C 22/06* (2006.01)
*C23C 22/50* (2006.01)
*C23C 22/53* (2006.01)

(52) U.S. Cl. ..... 148/247; 148/243; 148/274; 148/283; 106/14.11; 106/14.44

(58) Field of Classification Search ..... 148/243, 148/276–277, 284, 287, 247, 274, 283; 106/14.11, 106/14.44; 205/199, 201
See application file for complete search history.

(56) References Cited

U.S. PATENT DOCUMENTS 4,148,670 A 4/1979 Kelly
4,338,140 A 7/1982 Reghi
4,457,790 A * 7/1984 Lindert et al. ..... 148/247
5,143,562 A 9/1992 Boulos
5,244,512 A 9/1993 Kawasaki et al.
5,281,282 A 1/1994 Dolan et al.
5,342,456 A 8/1994 Dolan
5,356,490 A 10/1994 Dolan et al.
5,380,374 A * 1/1995 Tomlinson ..... 148/247
5,449,414 A 9/1995 Dolan
5,534,082 A 7/1996 Dollman et al.
5,536,336 A * 7/1996 Nakatsukasa et al. ..... 148/262
5,769,967 A 6/1998 Dolan
5,858,282 A 1/1999 Seiner et al.
5,897,716 A * 4/1999 Reghi et al. ..... 148/247
6,059,896 A 5/2000 Ehara et al.
6,361,833 B1 3/2002 Nakada et al.
6,440,231 B1 * 8/2002 Beiersdorf et al. ..... 148/261

FOREIGN PATENT DOCUMENTS

| | | |
|---|---|---|
| BE | 853 269 | 8/1977 |
| CA | 2 226 524 | 1/1997 |
| GB | 2 165 165 A | 4/1986 |
| JP | 48-095325 | 12/1973 |
| JP | 56-136978 | 10/1981 |
| JP | 62-050496 | 3/1987 |
| JP | 4-341574 | 11/1992 |

(Continued)

OTHER PUBLICATIONS

English-language International Search Report mailed Sep. 17, 2002 in PCT/JP02/05860 (2 pages).
English translation of the International Preliminary Examination Report dated Jun. 17, 2003 in PCT/JP02/05860 (5 pages).
Supplementary European Search Report for PCT/JP020586 dated Aug. 8, 2006.

*Primary Examiner*—Roy King
*Assistant Examiner*—Lois Zheng
(74) *Attorney, Agent, or Firm*—Flynn, Thiel, Boutell & Tanis, P.C.

(57) ABSTRACT

The present invention is the method for surface treatment of a metal material containing iron and/or zinc, containing component (A) and component (B); where (A) is a compound containing at least one metal element selected from the group consisting of Ti, Zr, Hf and Si, (B) is a compound containing fluorine as a supplying source of HF, wherein the ratio K=A/B between the total mole weight A of metal elements of Ti, Zr, Hf and Si in the compound of component (A) and the mole weight B which when the total fluorine atoms in the fluorine-containing compound of component (B) is converted to HF is within the range of $0.06 \leqq K \leqq 0.18$, and the concentration of component (A) indicated by the total mole concentration of metal elements of Ti, Zr, Hf and Si is within the region of 0.05 to 100 m mol/L. To the treating solution for surface treatment, at least one compound containing at least one metal element selected from the group consisting of Ag, Al, Cu, Fe, Mn, Mg, Ni, Co and Zn can be blended. It is possible to form a surface-treated film which is superior in corrosion resistance after being coated on the surface of a metal containing iron or zinc from a solution which does not contain a harmful component to the environment.

11 Claims, No Drawings

FOREIGN PATENT DOCUMENTS

| | | | |
|---|---|---|---|
| JP | 05-195242 | | 8/1993 |
| JP | 05-195244 | | 8/1993 |
| JP | 09-25436 | | 1/1997 |
| JP | 09-31404 | | 2/1997 |
| JP | 2000-199077 | | 7/2000 |
| JP | 2000-204485 | | 7/2000 |
| JP | 2001-240979 | | 9/2001 |
| WO | WO 85/05131 | * | 11/1985 |
| WO | WO 93/20260 | | 10/1993 |
| WO | WO96/21752 | A | 7/1996 |
| WO | WO00/52227 | | 9/2000 |
| WO | WO 00/61835 | | 10/2000 |

* cited by examiner

TREATING SOLUTION FOR METAL SURFACE TREATMENT AND A METHOD FOR SURFACE TREATMENT

FIELD OF THE INVENTION

The present invention relates to a composition for metal surface treatment which make it possible to form a surface treated film having excellent corrosion resistance after being coated on the surface of a metal containing iron and/or zinc, a treating solution for metal surface treatment, a method for metal surface treatment and a metal material having excellent corrosion resistance obtained by using said treating solution.

BACKGROUND OF THE INVENTION

As the method to form on a metal surface a surface treated film having excellent corrosion resistance after being coated, a zinc phosphate process and a chromate process are currently used as an ordinary method. According to the zinc phosphate process, it is possible to form a film having excellent corrosion resistance on the surface of a steel such as cold rolled steel plate, zinc plated steel plate and a kind of aluminum alloy. However, at the zinc phosphate process, the generation of sludge, which is the byproduct of the reaction cannot be avoided. Further, according to the kind of aluminum alloy, sufficient corrosion resistance after being coated cannot be obtained. While, in the case of the aluminum alloy, it is possible to obtain sufficient properties after being coated by a chromate process. But, concerning the recent environmental regulations, the chromate process which contains harmful hexavalent chrome in the treated solution is becoming to be evaded. As the method for metal surface treatment, which does not contain a harmful component in the treated solution, various methods were proposed.

For example, in JP2000-204485A publication, a compound containing a nitrogen atom having a lone electron-pair or a non-chrome coating agent for metal surface treatment containing said compound and a zirconium compound are disclosed. This method makes it possible to obtain a surface treated film which is excellent in corrosion resistance and adhesion after being coated by the above-mentioned coating agent, and yet, in this method, harmful hexavalent chrome is not contained. However, in the case of said method, the metal material which can be treated is limited to the aluminum alloy alone, further, it is difficult to be applied to a body having a complex structure, because the surface treated film is formed by coating and drying.

Further, as the method to form a metal surface treated film having excellent adhesion and corrosion resistance after being coated by chemical reaction, various methods are disclosed, for example, JP56-136978A publication, JP9-25436A publication or JP9-31404A publication. However, in these cases, the metal material which can be treated is limited to the aluminum alloy alone. However, since the aluminum alloy originally has an excellent corrosion resistance, the actual uses are limited to a narrow use such as an aluminum DI can.

Furthermore, in JP2000-199077A publication, the method to form a metal surface treated film having an excellent corrosion resistance and adhesion after being coated is disclosed, and the important point of this method is to use a surface treating agent composed of a metal acetylacetonate and water-soluble inorganic titanium compound or water-soluble inorganic zirconium compound. By this method, the kinds of metal material which can be treated are extended to magnesium, magnesium alloys, zinc and zinc plated alloys other than an aluminum alloy. However, by this method, it is difficult to form a sufficient amount of a surface treated film on a surface of an iron such as cold rolling steel, that is, this method can not be expected at all to have an aimed effect on a surface of iron.

Still further, in JP5-195244 A publication, the method for metal surface treatment by a chrome-free coat type acid composition is disclosed. This method for metal surface treatment is characterized as follows. That is, an aqueous solution containing a component which can be a film having an excellent corrosion resistance is coated over the surface of metal, then baked and dried without rinsing so that the film is fixed. This method is not accompanied with any chemical reaction. Therefore, by this method, it is possible to form a film on the surface of a metal such as zinc plated steel plate, cold-rolled steel plate or an aluminum alloy. However, as with the invention disclosed in the above-mentioned JP2000-204485A publication, since the film is generated by coating and drying, this method can not be applied to a body having a complex structure.

As mentioned above, according to the prior arts, it was impossible to perform a surface treatment excelling in corrosion resistance and adhesion on various metal materials having broad extension from iron materials such as cold milling steel, zinc materials to light metals such as aluminum alloys, without containing a harmful component to the environment and not generating waste sludge.

DISCLOSURE OF THE INVENTION

The object of the present invention is to provide a composition for surface treatment which make it possible to form a surface-treated film having excellent corrosion resistance after being coated on the surface of a metal containing iron and/or zinc, a treating solution for metal surface treatment, a method for metal surface treatment and a metal material having an excellent corrosion resistance obtained by using said treating solution.

The present invention is a composition for surface treatment of a metal containing iron and/or zinc, which comprises component (A) and component (B);

(A) a compound containing at least one metal element selected from the group consisting of Ti, Zr, Hf and Si, (B) a compound containing fluorine as a supplying source of HF, wherein the ratio K=A/B between the total mole weight A of metal elements of Ti, Zr, Hf and Si in the compound of component (A) and the mole weight B which when the total fluorine atoms in the fluorine-containing compound of component (B) is converted to HF is within the range of $0.06 \leqq K \leqq 0.18$.

Further, the present invention is a composition for surface treatment of a metal containing iron and/or zinc, which comprises component (A), component (B) and component (C);

(A) a compound containing at least one metal element selected from the group consisting of Ti, Zr, Hf and Si, (B) a compound containing fluorine as a supplying source of HF, (C) a compound containing at least one metal element selected from the group consisting of Ag, Al, Cu, Fe, Mn, Mg, Ni, Co and Zn, wherein the ratio K=A/B between the total mole weight A of the metal elements of Ti, Zr, Hf and Si in the compound of component (A) and the mole weight B which when the total fluorine atoms in the fluorine-containing compound of component (B) is converted to HF is within the range of $0.03 \leqq K \leqq 0.167$.

Furthermore, the present invention is a treating solution for the surface treatment of a metal containing iron and/or zinc, which comprises component (A) and component (B);

(A) a compound containing at least one metal element selected from the group consisting of Ti, Zr, Hf and Si, (B) a compound containing fluorine as a supplying source of HF, wherein the ratio K=A/B between the total mole weight A of the metal elements of Ti, Zr, Hf and Si in the compound of component (A) and the mole weight B which when the total fluorine atoms in the fluorine-containing compound of component (B) is converted to HF is within the range of $0.06 \leqq K \leqq 0.18$, and the concentration of component (A) indicated by the total mole concentration of the metal elements of Ti, Zr, Hf and Si is within the region of 0.05 to 100 m mol/L.

Still further, the present invention is a treating solution for the surface treatment of a metal containing iron and/or zinc, which comprises component (A), component (B) and component (C);

(A) a compound containing at least one metal element selected from the group consisting of Ti, Zr, Hf and Si, (B) a compound containing fluorine as a supplying source of HF, (C) a compound containing at least one metal element selected from the group consisting of Ag, Al, Cu, Fe, Mn, Mg, Ni, Co and Zn, wherein the ratio K=A/B between the total mole weight A of the metal elements of Ti, Zr, Hf and Si in the compound of component (A) and the mole weight B which when the total fluorine atoms in the fluorine-containing compound of component (B) is converted to HF is within the range of $0.03 \leqq K \leqq 0.167$, and the concentration of component (A) indicated by the total mole concentration of the metal elements of Ti, Zr, Hf and Si is within the region of 0.05 to 100 m mol/L. It is desirable to adjust the blending amount of the compound of component (C) in the solution for surface treatment of a metal to the sufficient amount to make the free fluorine ion concentration in the treating solution measured by a fluorine ion meter smaller than 500 ppm.

To each of the above-mentioned treating solutions for the surface treatment of a metal, at least one compound selected from the group consisting of $HClO_3$, $HBrO_3$, $HNO_3$, $HNO_2$, $HMnO_4$, $HVO_3$, $H_2O_2$, $H_2WO_4$, $H_2MoO_4$ and salts of these oxygen acids can be added. Further, to each of the above-mentioned treating solutions for the surface treatment of a metal, at least one kind of surface-active agent selected from the group consisting of a nonionic surface-active agent, an anionic surface-active agent and a cationic surface-active agent can be added, and can adjust pH within the range of 2 to 6. Furthermore, to each of the above-mentioned treating solutions for the surface treatment of a metal, at least one kind of polymer component selected from the group consisting of a water-soluble polymer compound and a water-dispersible polymer compound can be added.

Yet further, the present invention is the method for the surface treatment of a metal containing iron and/or zinc characterized in that the cleaned metal surface by previous degreasing treatment is contacted with any one of the above-mentioned treating solutions for surface treatment of a metal. The present invention is the method for the surface treatment of a metal containing iron and/or zinc characterized in using the cleaned metal surface by a previous degreasing treatment as a cathode and treating by electrolysis in any one of the above-mentioned treating solutions for the surface treatment of a metal. Further, in the case when the treating solutions for surface treatment of a metal to which the above-mentioned surface-active agent is blended and whose pH is adjusted to the range of 2 to 6, it is possible to carry out the degreasing and cleaning treatment and surface film forming treatment.

Moreover, the present invention is the metal material having excellent corrosion resistance, possessing the surface-treated film layer on the surface of the iron metal material, which is formed by the above-mentioned method for surface treatment, composed of an oxide and/or a hydroxide of at least one kind of metal element selected from the group consisting of Ti, Zr, Hf and Si, and the amount of said surface-treated film layer is over 30 $mg/m^2$ by the converted amount to said metal elements. The present invention is the metal material having an excellent corrosion resistance, possessing a surface-treated film layer composed of an oxide and/or a hydroxide of at least one kind of metal element selected from the group consisting of Ti, Zr, Hf and Si formed by the above-mentioned method for surface treatment on the surface of a zinc metal material, and the amount of said surface treated film layer is over 20 $mg/m^2$ by the converted amount to said metal elements.

DESCRIPTION OF THE PREFERRED EMBODIMENT

The present invention relates to a technique to form a surface-treated film having an excellent corrosion resistance after being coated on the surface of a metal containing iron and/or zinc by chemical or electrochemical reaction. In the present invention, a metal containing iron and/or zinc means a metal material consisting of iron and/or zinc, such as steel plate, zinc-plated steel plate. Specifically, for example, an iron metal material such as a cold-rolled steel plate, hot-rolled steel plate, cast iron or sintered steel can be mentioned. The present invention can be applied not only to the metal material of iron or zinc or to the combined metal material of iron and zinc, but also to the combined metal material composed of a metal material containing at least one of iron or zinc and a metal material such as magnesium alloy or aluminum alloy, for instance, the combined metal material composed of steel plate, zinc-plated steel plate and an aluminum alloy or a magnesium alloy. Moreover, it can be applied to the sole metal material, e.g., a magnesium alloy or an aluminum alloy.

The composition for surface treatment of a metal containing at least one of iron or zinc of the present invention contains component (A) and component (B). As a specific example of the compound of component (A) containing at least one metal element selected from the group consisting of Ti, Zr, Hf and Si, for example, $TiCl_3$, $TiCl_4$, $Ti_2(SO_4)_3$, $Ti(SO_4)_2$, $Ti(NO_3)_4$, $H_2TiF_6$, salt of $H_2TiF_6$, TiO, $Ti_2O_3$, $TiO_2$, $TiF_4$, $ZrCl_4$, $Zr(SO_4)_2$, $Zr(NO_3)_4$, $H_2ZrF_6$, salt of $H_2ZrF_6$, $ZrO_2$, $ZrF_4$, $HfCl_4$, $Hf(SO_4)_2$, $H_2HfF_6$, salt of $H_2HfF_6$, $HfO_2$, $HfF_4$, $H_2SiF_6$, salt of $H_2SiF_6$, $Al_2O_3(SiO_2)_3$ or $SiO_2$ can be mentioned. These compounds can be used together.

As a specific example of the compound containing fluorine as a supplying source of HF, hydrofluoric acid can be used, and besides hydrofluoric acid, a fluorine compound such as $H_2TiF_6$, $TiF_4$, $H_2ZrF_6$, $ZrF_4$, $H_2HfF_6$, $HfF_4$, $H_2SiF_6$, $HBF_4$, $NaHF_2$, $KHF_2$, $NH_4HF_2$, NaF, KF, $NH_4F$ can be mentioned. These compounds can be used together.

To the composition for surface treatment of a metal of the present invention, component (C) can be further blended besides the above-mentioned components (A) and (B). Component (C) is the compound containing at least one metal element selected from the group consisting of Ag, Al, Cu, Fe, Mn, Mg, Ni, Co and Zn. These compounds are oxides, hydroxides, chlorides, sulfates, nitrates or carbonates of above-mentioned elements, and as specific examples, AgCl, $AlCl_3$, $FeCl_2$, $FeCl_3$, $MgCl_2$, $CuCl_2$, $MnCl_2$, $ZnCl_2$, $NiCl_2$, $CoCl_2$, $Ag_2SO_4$, $Al_2(SO_4)_3$, $FeSO_4$, $Fe_2(SO_4)_3$, $MgSO_4$, $CuSO_4$, $MnSO_4$, $ZnSO_4$, $NiSO_4$, $CoSO_4$, $AgNO_3$, $Al(NO_3)_3$, $Fe(NO_3)_3$, $Mg(NO_3)_2$, $Cu(NO_3)_2$, $Mn(NO_3)_2$, $Zn(NO_3)_2$, $Ni(NO_3)_2$ and $Co(NO_3)_2$ can be mentioned. These compounds can be used together.

At the actual use for the surface treatment of a metal, the above-mentioned composition of the present invention is used by diluting it with water or by dissolving it into water. Namely, the composition is prepared as the treating solution for the surface treatment of a metal, and then is used. At the preparation of the treating solution for the surface treatment of a metal, water is added to the composition for the surface treatment of a metal and adjusts the concentration of component (A) indicated by the total mole concentration of metal elements of Ti, Zr, Hf and Si to be within the region of 0.05 to 100 m mol/L. The treated film can be formed on the surface of the metal by contacting the metal material to be treated with the treating solution for surface treatment of a metal.

The metal elements of Ti, Zr, Hf and Si in the compound of component (A) are existing as $H_2MF_6$ (wherein M is at least one metal element selected from the group consisting of Ti, Zr, Hf and Si) in an aqueous solution containing a sufficient amount of HF. When the mole concentration of fluorine ion is smaller than six times as much as the concentration of component (A) indicated by the total mole concentration of metal elements of Ti, Zr, Hf and Si, these metal elements exist as salts of said $H_2MF_6$ and other acids. While, between $H_2MF_6$ and HF, the following chemical equilibrium comes into existence.

$$H_2MF_6+2H_2O \Leftrightarrow MO_2+6HF \quad (1)$$

When the metal material to be treated is soaked into the composition for surface treatment of a metal of the present invention, for example, when the metal material is iron, HF is consumed by etching reaction of $$Fe+3HF \Leftrightarrow FeF_3+3/2H_2 \quad (2)$$

That is, by the etching reaction shown by the reaction formula (2) HF is consumed and the equilibrium of (1) is shifted to the right, then $MO_2$, which is the main component of surface-treated film obtained by the present invention is formed. The obtained film is the oxide and/or hydroxide of the metal element M. At the present time, a detailed investigation of this film has not yet been carried out, however, the effect for the improvement of corrosion resistance and adhesion is not influenced by the feature of the film, namely, whether the film is an amorphous or crystalline substance.

The pH of the treating solution for the surface treatment of a metal of the present invention is not restricted, however, at the occurrence of an etching reaction of the metal material to be treated, the stability of the treating solution is taken into consideration, a desirable pH is 2 to 6 and more desirable pH is from 3 to 5.

When the composition for surface treatment or the treating solution for surface treatment contains components (A) and (B) and does not contain component (C), it is necessary that the ratio K=A/B between the total mole weight A of the metal elements of Ti, Zr, Hf and Si and the mole weight B when the total F in the above-mentioned fluorine-containing compound is converted to HF is within the range of $0.06 \leqq K \leqq 0.18$ to form a film having an excellent corrosion resistance and adhesion by reaction formulae (1) and (2). When K is lager than 0.18, although it is possible to form enough of the film to obtain the corrosion resistance and adhesion, the stability of the composition for the surface treatment or the treating solution for the surface treatment is spoiled and the continuous operation becomes difficult. When K is smaller than 0.06, since it becomes difficult to shift the equilibrium of (1) to the right, a film having a sufficient amount to obtain the corrosive resistance and adhesion can-not be formed in a short time. Especially, when K is small, since the film formation on an iron material is very difficult, it becomes difficult to form a surface-treated film having an excellent corrosion resistance after being coated by a chemical or electrochemical reaction on the surface of a combined metal material composed of a steel plate, zinc-plated steel plate and aluminum alloy or magnesium alloy in a short time.

To the composition for surface treatment or the treating solution for surface treatment of the present invention, component (C) can be further blended besides the above-mentioned components (A) and (B). By blending component (C), at least one metal element in the compound of component (C) selected from the group consisting of Ag, Al, Cu, Fe, Mn, Mg, Ni, Co and Zn forms a complex fluorine compound with HF or a fluorine ion in the treating solution and shifts the equilibrium of (1) to the right and effects to promote the film-forming reaction. By adding at least one element which generates a complex fluorine compound selected from the group consisting of Ag, Al, Cu, Fe, Mn, Mg, Ni, Co and Zn, the concentration of free fluorine ions can be regulated, and the reactivity of the treating solution for surface treatment of the present invention to the metal material to be treated can be voluntarily regulated. As the method for easy monitoring of the reactivity, a method to measure the concentration of free fluorine ions using a fluorine ion meter can be used. The concentration of free fluorine ions is desirably less than 500 ppm and more desirably less than 300 ppm. When the concentration of free fluorine ions is over 500 ppm, the concentration of HF in the treating solution becomes high, therefore the equilibrium of (1) is hard to shift to the right and it is difficult to form enough of the film to obtain corrosive resistance and adhesion.

When the composition for surface treatment or the treating solution for surface treatment contains components (A), (B) and (C), it is necessary that the above-mentioned ratio K is within the range of $0.03 \leqq K \leqq 0.167$ to form a film having an excellent corrosion resistance and adhesion by reaction formulae (1) and (2). When K is larger than 0.167, although it is possible to form enough of the film to obtain the corrosion resistance and adhesion in a short time, when component (C) is added, the stability of the composition for surface treatment or the treating solution for surface treatment is spoiled and continuous operation becomes difficult. When K is smaller than 0.03, since it becomes difficult to shift the equilibrium of (1) to the right, a film of a sufficient amount to obtain corrosive resistance and adhesion cannot be formed. Especially, when K is small, since the film formation on an iron material is very difficult, it becomes impossible to form a surface treated film having excellent corrosion resistance after being coated by chemical or electrochemical reaction on the surface of a combined metal material composed of a steel plate, zinc-plated steel plate and aluminum alloy or magnesium alloy in a short reaction time.

The present invention forms the surface-treated film on a metal surface using an equilibrium reaction between $H_2MF_6$ and HF. Accordingly, it is necessary that the concentration of the compound (when more than 2 kinds of said compounds are used, is the total mole concentration) containing at least one metal element selected from the group consisting of Ti, Zr, Hf and Si of component (A) in the treating solution for surface treatment of a metal is the concentration to regulate the total mole concentration of the metal elements of Ti, Zr, Hf and Si within the region of 0.05 to 100 m mol/L. When the total mole concentration as metal elements is within the range of 0.05 to 100 m mol/L, the metal element can be used alone or can be used together. If the total mole concentration is less than 0.05 m mol/L, since the concentration of the above-mentioned metal element, which is the component for the film, is remarkably small, it is difficult to form the film in a sufficient amount to obtain adhesion and corrosion resistance. Further, even if the total mole concentration is larger than 100 m mol/L, although the film forms, the remarkable improvement in adhesion and corrosion resistance cannot be expected, and is disadvantageous from the economical view point.

HF, which is the component in the treating solution for surface treatment of the present invention, acts as mentioned above and moreover, acts to maintain the component of the material to be treated dissolved out by an etching reaction as the fluorine complex in the treating solution. By said action of the HF, the treating solution for surface treatment of the present invention does not generate sludge. Further, when the treating amount of the metal material to be treated is remarkably large to the amount of treating solution, it is possible to add acids other than HF or a chelating agent to chelate metal ions dissolved out from the metal material to be treated, for the purpose of solubilizing the dissolved out component of material to be treated. As an example of an acid which can be used in the present invention, an inorganic acid such as sulfuric acid or hydrochloric acid, or an organic acid such as acetic acid, oxalic acid, tartaric acid, citric acid, succinic acid, gluconic acid or phtalic acid can be mentioned.

In the treating solution for surface treatment of the present invention, at least one compound selected from the group consisting of $HClO_3$, $HBrO_3$, $HNO_3$, $HNO_2$, $HMnO_4$, $HVO_3$, $H_2O_2$, $H_2WO_4$, $H_2MoO_4$ and salts of these oxygen acids can be added. Said one compound selected from the group consisting of these oxygen acids and salts of these oxygen acids acts as an oxidant to the metal material to be treated and promotes the film-forming reaction of the present invention.

The adding concentration of the above-mentioned at least one compound selected from the group consisting of $HClO_3$, $HBrO_3$, $HNO_3$, $HNO_2$, $HMnO_4$, $HVO_3$, $H_2O_2$, $H_2WO_4$, $H_2MoO_4$ and salts of these oxygen acids is not restricted, however, when it is used as an oxidant, enough effect can be expected at the adding amount of 10-5000 ppm. Further, as represented by $HNO_3$, when said acids act as the acid to maintain the etched component of metal material to be treated in the treating solution, it is possible to increase the adding amount if necessary.

The method for surface treatment of the present invention can be illustrated as follows. Namely, the surface is treated by a degreasing treatment according to the ordinary method, and the cleaned metal material to be treated is contacted with the treating solution for surface treatment. Accordingly, a film composed of an oxide and/or hydroxide of at least one metal element selected from the group consisting of Ti, Zr, Hf and Si is deposited and a surface-treated film layer having a good adhesion and corrosion resistance is formed. As the substantial method for this contacting process, any kind of process, e.g., spray treatment, immersion treatment or pouring treatment, can be used, and the properties of the product is not influenced by the treating method. From the chemical view point, it is difficult to obtain the hydroxide of above-mentioned metal as a pure hydroxide, and in general, the form the oxide of the above-mentioned metal to which hydrated water is attached is considered to be in the category of a hydroxide. Therefore, the hydroxide of said metal finally becomes the oxide by heating. The structure of the surface-treated layer of the present invention is considered to be a mixed state of an oxide and a hydroxide when dried by ordinary temperature or by low temperature after surface treatment. When dried by a high temperature after surface treatment, the structure of the surface-treated layer is considered to be composed of an oxide alone or oxide-rich.

In the present invention, the using condition of the treating solution for surface treatment is not restricted. The reactivity of the treating solution for surface treatment of the present invention can be voluntarily regulated by changing K=A/B, which is the ratio between the total mole weight A of the metal elements Ti, Zr, Hf and Si in the compound of component (A) and the mole weight B when the total fluorine in the fluorine-containing compound of component (B) is converted to HF. Further, the reactivity can be also voluntarily regulated by adding at least one element which forms a complex fluorine selected from the group consisting of Ag, Al, Cu, Fe, Mn, Mg, Ni, Co and Zn in component (C). Therefore, the treating temperature and treating time can be voluntarily changed by combining with the reactivity of the treating solution.

Further, to each of the above-mentioned treating solutions for surface treatment of a metal, at least one kind of surface-active agent selected from the group consisting of nonionic surface-active agents, anionic surface-active agents and cationic surface-active agents can be added, and can adjust the pH within the range of 2 to 6. At the surface treatment of a metal material using this treating solution for surface treatment, a good film can be formed without previous degreasing and cleaning treatment of the metal material to be treated. That is, this treating solution for surface treatment of a metal can be used simultaneously as a surface-treating agent and a degreasing agent.

To the treating solution for surface treatment of the present invention, at least one kind of polymer component selected from the group consisting of a water-soluble polymer compound and a water-dispersible polymer compound can be added. The metal material whose surface is treated by the treating solution for surface treatment of the present invention has sufficient corrosion resistance, however, if the additional function, lubricating ability is required, a polymer compound which meets the requirement can be selected and added. Thus the physical property of the treated film can be modified. As a specific example of the above-mentioned water-soluble polymer compound and water-dispersible polymer, for example, polyvinyl alcohol, poly(meta)acrylic acid, copolymer of acrylic acid and methacrylic acid, copolymer of ethylene with acrylic monomer such as (meta)acrylic acid or (meta)acrylate, copolymer of ethylene with vinylacetate, polyurethane, amino-denatured phenolic resin, polyester resin and epoxy resin, which are normally used for the surface treatment of a metal, can be mentioned.

Further, when the surface-treated film layer is formed using electrolysis, using the cleaned metal surface by previous degreasing treatment as a cathode, and treated by electrolysis using a surface-treating solution containing a compound which contains at least one metal element selected from the group consisting of Ti, Zr, Hf and Si of component (A) and a fluorine-containing compound and/or an inorganic acid as a supplying source of HF for component (B), then rinsed by water, as the inorganic acid to be used, at least one acid selected from the group consisting of nitric acid, sulfuric acid, acetic acid and hydrochloric acid can be mentioned.

At least one metal element selected from the group consisting of Ti, Zr, Hf and Si supplied from component (A) and HF and/or the inorganic acid supplied from component (B) form soluble salt in the aqueous acid solution and are dissolved. When a metal material is set up as a cathode and treated by electrolysis, a reductive reaction of hydrogen occurs at the cathode surface and the pH value increases. Along with the increase in the pH value, the stability of the at least one metal element selected from the group consisting of Ti, Zr, Hf and Si deteriorates and a surface-treated film forms as a hydroxide-containing oxide or water.

In the case of this electrolysis treatment, it is desirable that K=A/B, which is the ratio between the total mole weight A of the metal elements Ti, Zr, Hf and Si and the mole weight B which, when the total fluorine in the fluorine-containing compound is converted to HF, is $K \leqq 0.167$. In the case of cathode electrolysis treating, since the etching reaction of the metal material to be treated does not occur and the surface-treated film forms by a reductive reaction, there is no lower limit of K. While, when K is larger than 0.167, since it is possible that the precipitating reaction occurs not only at the cathode surface but also in the bulk surface-treating solution along with the pH value elevating phenomenon by electrolysis, it is better to avoid electrolysis treatment over the upper limit of K.

The present invention makes it possible to remarkably improve the corrosion resistance of a metal material by forming a surface-treated film layer composed of an oxide and/or hydroxide of a metal element selected from the group consisting of Ti, Zr, Hf and Si on the surface of the metal material. An oxide and/or hydroxide of said metal has a chemical property which has a high resistance against an acid or alkali and is chemically stabilized. At the actual corrosive environment of a metal, at an anode, where dissolving out of metal occurs, the pH value is reducing and at the cathode, where the reductive reaction of hydrogen occurs, the pH value is elevating. Therefore, in the case of a surface-treated film, which is inferior in acid resistance and alkali resistance, the film is dissolved under the corrosive environment and the effect of it is lost. Since the main component of the surface treated film layer of the present invention is not easily dissolved by an acid or alkali, the excellent effect of the film can be maintained even under the corrosive environment.

Since the oxide and hydroxide of said metal element forms a network structure through the metal and oxygen, it can be an excellent barrier film. Although the state of corrosion changes along with the environment in which the film is used, ordinarily, the corrosion is an oxygen demand type in the presence of water and oxygen, and the corrosive speed is promoted by the presence of a chloride. Since the surface treated film layer of the present invention has a good barrier effect against water, oxygen and a corrosion promotion component, it can perform an excellent corrosion resistance.

For the purpose of enhancing the corrosion resistance of an iron metal material such as cold-rolled steel plate, hot-rolled steel plate, cast iron or sintered steel using the above-mentioned barrier effect, an adhered amount over 30 $mg/m^2$ converted into said metal element is necessary, desirably, the adhered amount is over 40 $mg/m^2$ and more desirably over 50 $mg/m^2$. For the purpose of enhancing the corrosion resistance of a zinc metal material such as zinc, zinc-plated steel plate or galvannealed steel plate, an adhered amount over 20 $mg/m^2$ converted into said metal element is necessary and, desirably, the adhered amount is over 30 $mg/m^2$. Referring to the adhered amount, there is no upper limit, however, when the amount exceeds 1 $g/m^2$, cracks are easily generated on the surface-treated film layer and it becomes difficult to form a uniform film. Therefore, in both cases of an iron metal material and a zinc metal material, the desirable upper limit of the adhered amount is 1 $g/m^2$ and, more desirably, is 800 $mg/m^2$.

EXAMPLE

The composition for surface treatment, the treating solution for surface treatment and the method for surface treatment of the present invention will be illustrated more readily in according to the Examples and Comparative Examples, however, they are not intended to restrict the scope of the claims of the present invention. A material to be treated, a degreasing agent and a coating are voluntarily selected among the materials which are on the market, and not intended to restrict the actual uses of the composition for surface treatment, the treating solution for surface treatment and the method for surface treatment of the present invention.

Test Plating

The abbreviation marks and details of the test plates used in the Examples and Comparative Examples are shown as follows.

SPC: cold rolled steel plate (JIS-G-3141)

GA: both side galvannealed alloy zinc plated steel plate (45 $g/m^2$)

Al: aluminum alloy plate (6000 type aluminum alloy)

Mg: magnesium alloy plate (JIS-H-4201)

Treating Process

Examples and Comparative Examples, except zinc phosphate treatment are treated by the following process.

alkali degreasing→rinsing by water→film-forming treatment→rinsing by water→rinsing by D.I. water→drying Zinc phosphate treatment in Comparative Example is treated by the following process.

alkali degreasing→rinsing by water→surface conditioning→zinc phosphate treatment→rinsing by water→rinsing by D.I. water→drying Coating chromate treatment in Comparative Examples is treated by the following process.

alkali degreasing→rinsing by water→rinsing by D.I. water→drying→coating of chromate treatment solution→drying In the Examples and Comparative Examples, the alkali degreasing is carried out as follows. That is, Fine Cleaner L4460 (T.M.: Product of Nihon Parkerizing) is diluted to a 2% concentration by city water and sprayed onto a plate to be plated at 40° C. for 120 sec.

The rinsing by water and rinsing by D.I. water after the film treatment is carried out by spraying water or D.I. water onto a plate to be plated at room temperature for 30 sec.

Example 1

An aqueous solution of titanium sulfate (IV) and hydrofluoric acid are used and the composition for surface treatment, whose mole weight ratio K of Ti and HF is 0.16 and Ti concentration is 2 g/L, is prepared. The obtained composition for surface treatment is diluted by D.I. water, then a $NaHF_2$ reagent and a NaOH reagent are added, and the treating solution for surface treatment whose K is 0.06, Ti mole concentration is 10 m mol/L and pH is 2.8 is prepared. The free fluorine ion concentration in this treating solution for surface treatment is measured by a Fluorine Ion Meter (product of TOA Electronics Ltd.: IM-55G), and the result is 510 ppm.

After being degreased, the test plate is rinsed by water and is set up as a cathode. A carbon electrode is used as an anode, and the surface treatment by electrolysis is carried out for 5 sec at 5 A/$dm_2$ electrolysis condition in the above-mentioned treating solution for surface treatment heated to the temperature of 35° C.

Example 2

As aqueous solution of hexafluorotianic acid (IV) and hydrofluoric acid are used and the composition for surface treatment, whose mole weight ratio K of Ti and HF is 0.06 and Ti concentration is 1 g/L, is prepared. The obtained composition for surface treatment is diluted by D.I. water, then an aqueous solution of titanium sulfate (IV) is added and the solution, whose K is 0.16 and Ti mole concentration is 0.05 mmol/L, is prepared and, further, 50 ppm of $HBrO_3$ reagent is added. Thus, the treating solution for surface treatment is prepared.

The test plate is rinsed by water after being degreased, then soaked into the obtained treating solution for surface treatment heated to the temperature of 40° C. and surface treatment is carried out for 90 sec.

Example 3

An aqueous solution of hexafluorozirconic acid (IV), an aqueous solution of zirconiumnitrate (IV) and hydrofluoric acid are used and the solution, whose mole weight ratio K of Zr and HF is 0.18 and Zr mole concentration is 50 mmol/L, is prepared. Further, 5000 ppm of a $NaNO_3$ reagent and a water-soluble acrylic polymer compound (AC-10L: product of Nihon Jyunnyaku) is added so that the solids concentration is 1% and the treating solution for surface treatment is prepared.

The test plate is rinsed by water after being degreased, then soaked into the obtained treating solution for surface treatment heated to the temperature of 50° C. and surface treatment is carried out for 60 sec.

Example 4

An aqueous solution of zirconiumnitrate (IV), an aqueous solution of hexafluorosilicic acid (IV) and a $NH_4F$ reagent are used and the solution, whose mole ratio of Zr and Si is 1:1, mole weight ratio K of total mole weight of Zr and Si and HF is 0.08 and total mole concentration of Zr and Si is 100 mmol/L, is prepared. To the obtained solution, 150 ppm of $HClO_3$ reagent and 50 ppm of $H_2WO_4$ reagent are added, thus, the treating solution for surface treatment is prepared.

The test plate is rinsed by water after being degreased, then soaked into the obtained treating solution for surface treatment heated to the temperature of 30° C. and surface treatment is carried out for 90 sec.

Example 5

An aqueous solution of titanium sulfate (IV) and hydrofluoric acid are used and the composition for surface treatment, whose mole weight ratio K of Ti and HF is 0.16 and Ti concentration is 2 g/L, is prepared. The obtained composition for surface treatment is diluted by city water, then a $NaHF_2$ reagent is added, and the treating solution for surface treatment whose K is 0.03 and Ti mole concentration is 1 mmol/L, is prepared. Further, to the obtained solution, 300 ppm as Ag of a $AgNO_3$ reagent and a NaOH reagent are added and the treating solution for surface treatment, whose pH is 3.5, is obtained. The free fluorine ion concentration in this treating solution for surface treatment is measured by a Fluorine Ion Meter and the result is 250 ppm.

The test plate is rinsed by water after being degreased, then soaked into the obtained treating solution for surface treatment heated to the temperature of 45° C. and surface treatment is carried out for 120 sec.

Example 6

An aqueous solution of hexafluorotitanic acid (IV) and hydrofluoric acid are used and the composition for surface treatment, whose mole weight ratio K of Ti and HF is 0.03 and Ti concentration is 10 g/L, is prepared. The obtained composition for surface treatment is diluted by city water, then an aqueous solution of titanium sulfate (IV) is added and the solution, whose K is 0.167 and Ti mole concentration is 100 mmol/L, is prepared and, further, 50 ppm of a $HBrO_3$ reagent, 15 ppm as Al of a $Al(NO_3)_3$ reagent, 10 ppm as Fe of a $Fe(NO_3)_3$ reagent and an aqueous solution of ammonia are added. Thus, the treating solution for surface treatment having a pH of 4.1 is prepared. The free fluorine ion concentration in this treating solution for surface treatment is measured by a Fluorine Ion Meter and the result is 30 ppm.

The test plate is rinsed by water after being degreased, then soaked into the obtained treating solution for surface treatment heated to the temperature of 50° C. and surface treatment is carried out for 60 sec.

Example 7

An aqueous solution of hexafluorozirconic acid (IV) and a $NH_4F$ reagent are used and the solution, whose mole weight ratio K of Zr and HF is 0.1 and Zr mole concentration is 1 mmol/L, is prepared. Further, 100 ppm of a $NaNO_2$ reagent, 2000 ppm as Mg of a $Mg(NO_3)_2$ reagent and an aqueous solution of ammonia are added and the treating solution for surface treatment whose pH is 4.5 is prepared. The free fluorine ion concentration in this treating solution for surface treatment is measured by a Fluorine Ion Meter, and the result is 5 ppm.

The test plate is rinsed by water after being degreased, then soaked in the obtained treating solution for surface treatment heated to the temperature of 40° C. and surface treatment is carried out for 90 sec.

Example 8

An aqueous solution of hexafluorozirconate (IV) and hydrofluoric acid are used and the composition for surface treatment, whose mole weight ratio K of Zr and HF is 0.15 and Zr concentration is 20 g/L, is prepared. The obtained composition for surface treatment is diluted by city water, then a $NH_4F$ reagent is added and the solution, whose K is 0.08 and Zr mole concentration is 10 mmol/L, is prepared. Further, 5 ppm Cu of a $Cu(NO_3)_2$ reagent, 100 ppm as Mn of a $Mn(NO_3)_2$ reagent, 1500 ppm as Zn of a $Zn(NO_3)_2$ reagent and an aqueous solution of ammonia are added and the treating solution for surface treatment whose pH is 3.0 is prepared. The free fluorine ion concentration in this treating solution for surface treatment is measured by a Fluorine Ion Meter and the result is 200 ppm.

The test plate is rinsed by water after being degreased, then soaked in the obtained treating solution for surface treatment of 35° C. and applied to the surface by spraying for 120 sec., thus the surface treatment is carried out.

Example 9

Hafnium fluoride and hydrofluoric acid are used and the solution, whose mole weight ratio K of Hf and HF is 0.15 and Hf mole concentration is 0.05 mmol/L, is prepared. Further, 1 ppm Cu of a $Cu(NO_3)_2$ reagent, 100 ppm of $H_2MoO_4$ reagent, 10 ppm of a 35%-$H_2O_2$ aqueous solution and an aqueous solution of ammonia are added and the treating solution for surface treatment whose pH is 5.0 is prepared. The free fluorine ion concentration in this treating solution for surface treatment is measured by a Fluorine Ion Meter and the result is 1 ppm.

The test plate is rinsed by water after being degreased, then soaked in the obtained treating solution for surface treatment of 40° C. and applied to the surface by spraying for 120 sec., thus, the surface treatment is carried out.

Example 10

An aqueous solution of hexafluorosilicic acid (IV) and hydrofluoric acid are used and the composition for surface treatment, whose mole weight ratio K of Si and HF is 0.14 and Si concentration is 10 g/L, is prepared. The obtained composition for surface treatment is diluted by city water and the Si mole concentration adjusted to 50 m mol/L, after that, 50 ppm Ni of a $Ni(NO_3)_2$ reagent, 800 ppm as Co of $Co(NO_3)_2$ reagent, 15 ppm of $H_2MoO_4$ reagent and 50 ppm of a $HVO_3$ reagent are added and the pH of the solution adjusted to 5.9 by further adding an aqueous solution of ammonia. More over, 2 g/L of polyoxyethylenenonylphenylether (addition mole numbers of ethylene oxide: 12 moles), which is a nonionic surface active detergent, is added and the treating solution for surface treatment is prepared. The free fluorine ion concentration in this treating solution for surface treatment is measured by a Fluorine Ion Meter and the result is 500 ppm.

The test plate is not degreased, then soaked into the obtained treating solution for surface treatment of 50° C. and applied to the surface by spraying for 90 sec., thus, the surface treatment is carried out.

Comparative Example 1

An aqueous solution of titanium sulfate (IV) and hydrofluoric acid are used and the composition for surface treatment, whose mole weight ratio K of Ti and HF is 0.1 and Ti concentration is 5 g/L, is prepared. The obtained composition for surface treatment is diluted by D.I. water, then a $NaHF_2$ reagent is added and the treating solution for surface treatment, whose K is 0.02 and Ti mole concentration is 90 mmol/L, is prepared.

The test plate is rinsed by water after being degreased, then soaked into the obtained treating solution for surface treatment heated to the temperature of 50° C. and surface treatment is carried out for 120 sec.

Comparative Example 2

An aqueous solution of hexafluorozirconic acid (IV) and a $NH_4F$ reagent are used and the solution, whose mole weight ratio K of Zr and HF is 0.17 and Zr mole concentration is 0.02 mmol/L, is prepared.

The test plate is rinsed by water after being degreased, then soaked in the obtained treating solution for surface treatment of 45° C. and applied to the surface by spraying for 120 sec., thus, the surface treatment is carried out.

Comparative Example 3

Alchrom 713 (T.M.: product of Nihon Parkerizing Co., Ltd.), which is a chromic chromate treating agent on the market, is diluted by city water to a 3.6% concentration, then its total acidity and free acid acidity are adjusted to the center value disclosed in the brochure.

The test plate is rinsed by water after being degreased, then soaked into said chromate treating solution heated to the temperature of 35° C. and chromate treatment is carried out for 60 sec.

Comparative Example 4

Palcoat 3756 (T.M.: product of Nihon Parkerizing Co., Ltd.), which is the chrome-free treating agent on the market, is diluted by city water to a 2% concentration, then its total acidity and free acid acidity are adjusted to the center value disclosed in the brochure.

The test plate is rinsed by water after being degreased, then soaked in said chrome-free treating solution heated to the temperature of 40° C. and chrome-free treatment is carried out for 60 sec.

Comparative Example 5

The test plate is rinsed by water after being degreased, then the solution prepared by diluting Prepalene ZN (T.M.: product of Nihon Pakerizing Co., Ltd.), which is a surface-conditioning agent, by city water to a 0.1% concentration is sprayed at room temperature for 30 sec. Palbond L3020 (T.M.: product of Nihon Parkerizing Co., Ltd.) is diluted to a 4.8% concentration by city water, and its total acidity and free acidity are adjusted to the center value disclosed in the brochure. Thus the zinc phosphate treating solution is prepared. The above-mentioned test plate is soaked in said zinc phosphate chemical treating solution heated to the temperature of 42° C., and a zinc phosphate film is formed.

Comparative Example 6

Zinchrom 1300AN (T.M.: product of Nihon Parkerizing Co., Ltd.) is diluted by D.I. water and coated using a bar coater and dried so that the amount of Cr of 30 mg/$m^2$.

Each of the test plates whose surface is treated in the above-mentioned Examples and Comparative Examples is evaluated according to the following items. That is, evaluation of the appearance of a surface-treated film, amount of surface-treated film layer, corrosion resistance of surface-treated film layer and coating performance.

Appearance of Surface-Treated Film

The appearance of surface-treated plate by visual inspection. Results for the appearance evaluation of the surface-treated film are summarized in Table 1.

TABLE 1

| | Appearance after surface treatment | | | | |
|---|---|---|---|---|---|
| | SPC | GA | EG | Al | Mg |
| Example 1 | U.I.C. | U.G.B. | U.G.B. | U.W.C. | U.W.C. |
| Example 2 | U.I.C. | U.G.B. | U.G.B. | U.W.C. | U.W.C. |
| Example 3 | U.I.C. | U.G.B. | U.G.B. | U.W.C. | U.W.C. |
| Example 4 | U.I.C. | U.G.B. | U.G.B. | U.W.C. | U.W.C. |
| Example 5 | U.I.C. | U.G.B. | U.G.B. | U.W.C. | U.W.C. |
| Example 6 | U.I.C. | U.G.B. | U.G.B. | U.W.C. | U.W.C. |
| Example 7 | U.I.C. | U.G.B. | U.G.B. | U.W.C. | U.W.C. |
| Example 8 | U.I.C. | U.G.B. | U.G.B. | U.W.C. | U.W.C. |
| Example 9 | U.I.C. | U.G.B. | U.G.B. | U.W.C. | U.W.C. |
| Example 10 | U.I.C. | U.G.B. | U.G.B. | U.W.C. | U.W.C. |
| Comparative Example 1 | uneven | uneven | uneven | white, uneven | white, uneven |

TABLE 1-continued

| | Appearance after surface treatment | | | | |
|---|---|---|---|---|---|
| | SPC | GA | EG | Al | Mg |
| Comparative Example 2 | N.F. | N.F. | N.F. | F.N.F. | F.N.F. |
| Comparative Example 3 | N.F. | S.Y. | S.Y | G.C. | G.C. |
| Comparative Example 4 | N.F. | N.F. | N.F. | W.U. | white, uneven |
| Comparative Example 5 | G.U. | G.U. | G.U. | white, uneven | white, uneven |
| Comparative Example 6 | uniform | uniform | uniform | uniform | Uniform |

In Table 1, the meaning of each abbreviated codes is indicated as follows; U.I.C.: uniform interference color, U.G.B.: uniform grayish black color, U.W.C.: uniform white color, G.U.: grayish uniform, N.F.: not formed, F.N.F.: film is not formed, G.C.: golden color, S.Y.: slightly yellowish As shown in Table 1, in the Examples, uniform film is obtained on each test plates. On the contrary, in Comparative Examples, a uniform film cannot be formed.

Amount of Surface-Treated Film Layer

The amount of the surface-treated film layer of the surface-treated plates is obtained in the above-mentioned Examples and Comparative Examples. At the measurement, an X-ray fluorescence analyzer (product of Rigaku Electric Industries: system 3270) is used and its elements in the film are quantitatively analyzed, and calculated. The results are summarized in Table 2.

TABLE 2

| | Amount of surface-treated film layer (Total amount of Ti, Zr, Hf and Si: mg/m$^{2)}$ | | |
|---|---|---|---|
| | SPC | GA | EG |
| Example 1 | 32 | 21 | 25 |
| Example 2 | 36 | 22 | 30 |
| Example 3 | 81 | 45 | 58 |
| Example 4 | 62 | 33 | 38 |
| Example 5 | 52 | 28 | 36 |
| Example 6 | 88 | 51 | 62 |
| Example 7 | 72 | 48 | 61 |
| Example 8 | 133 | 61 | 65 |
| Example 9 | 115 | 55 | 59 |
| Example 10 | 158 | 67 | 69 |
| Comparative Example 1 | 25 | 13 | 18 |
| Comparative Example 2 | Trace | Trace | Trace |
| Comparative Example 3 | Trace | Cr 35 | Cr 45 |
| Comparative Example 4 | Trace | Trace | Trace |
| Comparative Example 5 | Coating weight 2.3 g/m$^2$ | Coating weight 4.5 g/m$^2$ | Coating weight 2.1 g/m$^2$ |
| Comparative Example 6 | Cr 31 | Cr 32 | Cr 32 |

As shown in Table 2, in all cases of the Examples, the aimed adhering weight to the test plates can be obtained. While, in Comparative Examples 1 and 2, the adhering amount within the scope of the present invention cannot be obtained.

Evaluation for Corrosion Resistance of the Surface-Treated Film Layer

A 5%-NaCl aqueous solution is applied to the surface-treated plate obtained in the Examples and Comparative Examples by spraying (in the case of SPC: 2 hours, in the case of zinc-plated steel plate: 24 hours), the rust generated area after spraying (SPC: red rust. zinc-plated steel plate: white rust) is evaluated according to the following evaluation standard. The results of the evaluation for corrosion resistance of the surface-treated film layer are summarized in Table 3.

Rust generated area

Less than 5%: ⊙

Over than 5%, less than 10%: ○

Over than 5%, less than 20%: Δ

Over than 20%: x

TABLE 3

| | Corrosion resistance of surface treated film layer | | |
|---|---|---|---|
| | SPC | GA | EG |
| Example 1 | ○ | ⊙ | ⊙ |
| Example 2 | ○ | ⊙ | ⊙ |
| Example 3 | ⊙ | ⊙ | ⊙ |
| Example 4 | ⊙ | ⊙ | ⊙ |
| Example 5 | ⊙ | ⊙ | ⊙ |
| Example 6 | ⊙ | ⊙ | ⊙ |
| Example 7 | ⊙ | ⊙ | ⊙ |
| Example 8 | ⊙ | ⊙ | ⊙ |
| Example 9 | ⊙ | ⊙ | ⊙ |
| Example 10 | ⊙ | ⊙ | ⊙ |
| Comparative Example 1 | X | Δ | Δ |
| Comparative Example 2 | X | Δ | Δ |
| Comparative Example 3 | X | ○ | ○ |
| Comparative Example 4 | X | X | X |
| Comparative Example 5 | Δ | Δ | Δ |
| Comparative Example 6 | X | ⊙ | ⊙ |

As shown in Table 3, all of the Examples display a good corrosion resistance for each test plate. On the contrary, in the cases of Comparative Examples 1 and 2, the corrosion resistance is inferior to that of the Examples because the adhering amount is smaller than the lower limit of the scope of the claim of the present invention. In the case of Comparative Example 3, since it is a chromate treating agent, the corrosion resistance for GA and EG is comparatively good, however, the corrosion resistance for SPC is very bad. Since Comparative Example 4 is a chrome-free treating agent for aluminum alloys, sufficient corrosion resistance for SPC, GA and EG cannot be obtained. Comparative Example 5 is a zinc phosphate treating agent, which is usually used as the substrate for coating, however, the result is inferior to that of the Examples. Further, since Comparative Example 6 is a coating type chromate treating agent for zinc-plated steel plate, it displays good results to GA and EG, which are zinc plated steel plate, however, the result on SPC is inferior to the Examples.

Evaluation of Coating Performance (1) Preparation of Evaluation Plate

For the purpose of evaluating the coating performance of the surface-treated plates obtained in the Examples and Comparative Examples, coating is carried out by the following process.

cathodic electrodeposition coating→rinsing by D.I. water→baking→surfacer→baking→top coating→baking cathodic electrodeposition coating: epoxy type cathodic electrodeposition coating (Elecron 9400: product of Kansai Paint), electric voltage is 200V, thickness of film is 20 μm, baked at 175° C. for 20 minutes.

surfacer: aminoalkyd coating (AmilacTP-37 gray: product of Kansai Paint), spray coating, thickness of film is 35 μm, baked at 140° C. for 20 minutes.

top coating: aminoalkyd coating (AmilacTP-37 white: product of Kansai Paint), spray coating, thickness of film is 35 μm, baked at 140° C. for 20 minutes.

(2) Evaluation of Coating Performance

The coating performance of the surface-coated plates whose surface is coated by above-mentioned process. The evaluation items, evaluation method and abbreviation marks are shown below. Hereinafter, the coated film after the electrodeposition coating process is called an electrodeposition coated film and the coated film after the top coating is called a 3 coats-coated film.

① SST: Salt Spray Test (Electrodeposition Coated Film)

To an electrodeposition coated plate to which a cross-cut line is marked by a sharpened knife, aqueous solution of 5%-NaCl is sprayed for 840 hours (in accordance with JIS-Z-2371). After being sprayed, the maximum blistering width from both sides of the cross-cut line is measured.

② SDT: Warm Salt Water Dipping Test (Electrodeposition Coated Film)

An electrodeposition coated plate to which a cross-cut line is marked by a sharpened knife is soaked into an aqueous solution of 5%-NaCl elevated to the temperature of 50° C. for 240 hours. After being rinsed by city water and dried at room temperature, the cross-cut part of the electrodeposition coated film is peeled using a cellophane tape and the maximum peeled width from both side of the cross-cut part is measured.

③ 1st ADH: Primary Adhesion (3 Coats Coated Film)

100 checker marks of a 2 mm interval are marked using a sharpened knife on a 3 coats-coated film. The checker mark part is peeled using a cellophane tape and the number of peeled checker marks are counted.

④ 2nd ADH: Water-Resistant Secondary Adhesion (3 Coats-Coated Film)

A 3 coats-coated film is soaked in D.I. water of 40° C. for 240 hours. After soaking, 100 checker marks of a 2 mm interval are marked using a sharpened knife. The checker mark part is peeled using a cellophane tape and the number of peeled checker marks is counted.

⑤ CCT: Cyclic Corrosion Test

A 3 coats-coated film to which a cross-cut line is marked by a sharpened knife is placed into a complex environmental cycle testing apparatus and 60 cycles of the following test cycle are repeated. Salt water spray (5%-NaCl, 50° C., 27 hours)→drying (50° C., 3 hours)→salt water soaking (5%-NaCl, 50° C., 2 hours)→air-drying (25° C., 2 hours). After 60 cycles, the maximum blistering width from the cross-cut part is measured and evaluated according to the evaluation standard indicated as follows.

Both Sides Maximum Blistering Width

Less than 3 mm: ⊙

Over than 3 mm, less than 5 mm: ○

Over than 5 mm, less than 10 mm: Δ

Over than 10 mm: x

The evaluation of the coating performance of the electrodeposition coated film is summarized in Table 4.

TABLE 4

| | coating performance of electrodeposition coated film | | | | | |
|---|---|---|---|---|---|---|
| | SST | | | SDT | | |
| | SPC | GA | Al | SPC | GA | AL |
| Example 1 | 4 | 5.2 | 0.5 | 3.1 | 4.5 | 0.5 |
| Example 2 | 4 | 5 | 0.3 | 3.6 | 4.9 | 0.5 |
| Example 3 | 2.8 | 4.3 | 0.5 | 2.5 | 4 | 0.3 |
| Example 4 | 3.7 | 4.7 | 0.5 | 3.1 | 5 | 0.5 |
| Example 5 | 3.9 | 4.8 | 0.5 | 3.2 | 5.1 | 0.5 |
| Example 6 | 2.5 | 4.1 | 0.3 | 2.4 | 4.2 | 0.3 |
| Example 7 | 2.5 | 4 | 0.3 | 2.7 | 4 | 0.5 |
| Example 8 | 2.8 | 4 | 0.5 | 2 | 3.8 | 0.3 |
| Example 9 | 2.7 | 4 | 0.5 | 2.1 | 3.6 | 0.5 |
| Example 10 | 2.5 | 3.9 | 0.3 | 2 | 3.6 | 0.3 |
| Com. Exp. 1 | 10.0< | 6.5 | 0.6 | 10.0< | 6.2 | 1 |
| Com. Exp. 2 | 10.0< | 10.0< | 1.5 | 10.0< | 10.0< | 2.2 |
| Com. Exp. 3 | 10.0< | 6.7 | 0.5 | 10.0< | 5.8 | 0.3 |
| Com. Exp. 4 | 10.0< | 8.5 | 0.6 | 10.0< | 10.0< | 0.8 |
| Com. Exp. 5 | 3.7 | 5.5 | 0.5 | 6 | 5.8 | 1.2 |

As clearly understood from Table 4, the Examples show good corrosive resistance to all test plates. On the contrary, in Comparative Example 1, since the mole weight ratio K of Ti and HF is 0.02 and the HF concentration is higher than the Ti concentration in the treating bath, the precipitation of the surface-treated film is not sufficient and, thus, the corrosion resistance is not so good. Further, in Comparative Example 2, since the Zr concentration is 0.02 mmol/L and is not a sufficient Zr concentration to form the surface-treated film, the corrosion resistance is not so good too. Because Comparative Example 3 is a chromate treating agent for an aluminum alloy and Comparative Example 4 is a chrome-free treating agent for an aluminum alloy, the corrosion resistance of Al is good, but the corrosion resistance of the other test plates are obviously inferior to that of the Examples. Comparative Example 5 is a zinc phosphate treating agent, which is now usually used as the base for coating. However, also in Comparative Example 5, it is difficult to improve the corrosion resistance of all the test plates.

The results of the adhesion of the 3-coated film are summarized in Table 5.

TABLE 5

| | Coating performance of 3-coats coated film | | | | | | | | | | | |
|---|---|---|---|---|---|---|---|---|---|---|---|---|
| | 1st ADH | | | | 2nd ADH | | | | CCT | | | |
| | SPC | GA | Al | Mg | SPC | GA | Al | Mg | SPC | GA | Al | Mg |
| Example 1-Example 10 | 0 | 0 | 0 | 0 | 0 | 0 | 0 | 0 | ⊙ | ⊙ | ⊙ | ⊙ |
| Com. Exp. 1 | 0 | 0 | 0 | 0 | 5 | 3 | 0 | 0 | X | Δ | Δ | Δ |
| Com. Exp. 2 | 0 | 0 | 0 | 0 | 7 | 6 | 9 | 10 | X | X | Δ | Δ |
| Com. Exp. 3 | 0 | 0 | 0 | 0 | 20 | 0 | 0 | 0 | X | Δ | ⊙ | ⊙ |
| Com. Exp. 4 | 0 | 0 | 0 | 0 | 19 | 9 | 0 | 0 | X | X | ○ | Δ |
| Com. Exp. 5 | 0 | 0 | 0 | 0 | 0 | 0 | 0 | 0 | ⊙ | ⊙ | ○ | Δ |

As clearly shown in Table 5, the Examples show good adhesion to all the test plates. Regarding the 1st ADH, good results are obtained for all the Comparative Examples, however, regarding the 2nd ADH, there is no level which shows good adhesion to all test plates except zinc phosphate treatment. Further, regarding the CCT evaluation results for the 3-coats plating, Examples 1-10 show a good corrosion resistance for all test plates. On the contrary, in Comparative Examples 1-5, it is not possible to improve the corrosion resistance of all the test plates.

From the above-mentioned results, the following facts are obviously understood. That is, the precipitation of a surface-treated film having a good adhesion and corrosion resistance on the surface of SPC, GA, Al and Mg without changing the treating bath and treating condition is possible only by using the surface treating composition, the treating solution for surface treatment and the surface treating method of the present invention. Further, in Comparative Example 5, the generation of sludge, which is the by-product of zinc phosphate treatment, is observed in the treating bath after surface treatment. However, in the Examples of the present invention, the generation of sludge is not observed on any level.

INDUSTRIAL APPLICABILITY

The surface treating composition, the treating solution for surface treatment and the surface treating method of the present invention are remarkably excellent techniques, which were impossible by the conventional techniques. That is, the present invention is using a treating solution not containing a harmful component to the environment and makes it possible to form a surface-treated film having excellent corrosion resistance after being coated on a surface of a metal containing iron and/or zinc. Further, according to the present invention, the generation of sludge, which cannot be avoided in the conventional zinc phosphate treatment, can be prevented. The present invention is useful because it can be applied to a metal surface, such as a combined metal material composed of steel plate, zinc-plated steel plate and an aluminum alloy or magnesium alloy or to the surface of each metal alone. Further, since the present invention does not need a process for surface conditioning, it is possible to attempt the shortening of the treating process and the reduction of the space needed.

The invention claimed is:

1. A composition for surface treatment of a metal consisting of iron or iron and zinc, said composition comprising:

a first compound containing at least one metal selected from the group consisting of Ti, Zr, Hf and Si;

a second compound containing fluorine as a supplying source of HF; and a third compound containing at least one metal selected from the group consisting of Ag, Cu, and Co;

wherein a ratio K is equal to A/B, A being the total mole weight of Ti, Zr, Hf and Si in the first compound and B is the mole weight when the total fluorine in the second compound is converted to HF, and $0.03 \leqq K \leqq 0.10$.

2. A treating solution for surface treatment of a metal consisting of iron or iron and zinc, said solution comprising:

a first compound containing at least one metal selected from the group consisting of Ti, Zr, Hf and Si;

a second compound containing fluorine as a supplying source of HF; and a third compound containing at least one metal selected from the group consisting of Ag, Cu, Mg and Co;

wherein a ratio K is equal to A/B, A being the total mole weight of Ti, Zr, Hf and Si in the first compound and B is the mole weight when the total fluorine in the second compound is converted to HF, $0.03 \leqq K \leqq 0.10$ and the concentration of the first compound, indicated by the total mole concentration of Ti, Zr, Hf and Si, is about 0.05-100 mmol/L.

3. The treating solution of claim 2, wherein the blending amount of the third compound is sufficient to make the free fluorine ion concentration in the treating solution less than 500 ppm.

4. The treating solution of claim 2, additionally comprising at least one compound selected from the group consisting of $HClO_3$, $HBrO_3$, $HNO_3$, $HNO_2$, $HMnO_4$, $HVO_3$, $H_2O_2$, $H_2WO_4$, $H_2MoO_4$, and salts thereof.

5. The treating solution of claim 2, additionally comprising at least one kind of surface active agent selected from the group consisting of a nonionic surface active agent, an anionic surface active agent and a cationic surface active agent and the pH of the treating solution is from 2-6.

6. The treating solution of claim 2, additionally comprising at least one of a water-soluble polymer and a water-dispersible polymer.

7. A method of simultaneously degreasing and performing surface treatment of a metal consisting of at least one of iron and zinc, comprising the step of contacting a surface of the metal with the treating solution of claim 2.

8. A method of surface treating a metal containing at least one of iron and zinc and which has its surface previously cleaned by degreasing treatment, comprising the step of contacting the previously cleaned surface of the metal with the treating solution of claim 2.

9. An iron metal material having a surface-treated film layer composed of at least one of an oxide and a hydroxide of at least one metal selected from the group consisting of Ti, Zr, Hf and Si and which is formed by the method of claim 8, the amount of said surface-treated film layer is over 30 $mg/m^2$.

10. A zinc metal material having a surface-treated film layer composed of at least one of an oxide and a hydroxide of at least one metal selected from the group consisting of Ti, Zr, Hf and Si and which is formed by the method of claim 8, the amount of said surface-treated film layer is over 20 $mg/m^2$.

11. A method of surface treating a metal consisting of iron or zinc and iron comprising the steps of: degreasing a surface of the metal; inserting the decreased surface of the metal into the treating solution of claim 2; and performing electrolysis in the treating solution utilizing the metal as a cathode to surface treat the metal.

* * * * *